US005330187A

United States Patent [19]

Schmidt et al.

[11] Patent Number: 5,330,187

[45] Date of Patent: Jul. 19, 1994

[54] IRON GOLF CLUB HEAD WITH DUAL INTERSECTING RECESSES

[75] Inventors: Glenn H. Schmidt, Malibu; Richard C. Helmstetter, Carlsbad, both of Calif.

[73] Assignee: Callaway Golf Company, Carlsbad, Calif.

[21] Appl. No.: 52,697

[22] Filed: Apr. 30, 1993

Related U.S. Application Data

[63] Continuation-in-part of Ser. No. 921,857, Aug. 5, 1992, Pat. No. 5,282,625.

[51] Int. Cl.[5] ..... A63B 53/04

[52] U.S. Cl. ..... 273/169; 273/167 H; 273/172

[58] Field of Search ..... 273/169, 167 H, 167 A, 273/77 A, 78, 170, 172-175, 167 F, 167 J, 167 K

[56] References Cited

U.S. PATENT DOCUMENTS

| | | |
|---|---|---|
| D. 228,355 | 9/1973 | Penna . |
| D. 234,963 | 4/1975 | Kirata . |
| D. 247,383 | 2/1978 | Adkins . |
| D. 303,132 | 8/1989 | Muta . |
| D. 321,920 | 11/1991 | Parente et al. . |
| 1,854,548 | 4/1932 | Hunt . |
| 1,993,928 | 3/1935 | Glover . |
| 2,231,847 | 2/1941 | Dickson et al. . |
| 3,068,011 | 12/1962 | Sano . |
| 3,199,872 | 8/1965 | Taylor . |
| 3,847,399 | 11/1974 | Raymont . |
| 4,398,965 | 8/1983 | Campau . |
| 4,632,400 | 12/1986 | Boone . |
| 4,653,756 | 3/1987 | Sato . |
| 4,715,601 | 12/1987 | Lamanna . |
| 4,740,345 | 4/1988 | Nagasaki et al. . |
| 4,848,747 | 7/1989 | Fujimura et al. . |
| 4,854,581 | 8/1989 | Long . |
| 4,884,812 | 12/1989 | Nagasaki et al. . |
| 4,913,435 | 4/1990 | Kobayashi . |
| 4,928,972 | 5/1990 | Nakanishi et al. . |
| 4,957,294 | 9/1990 | Long . |
| 4,964,640 | 10/1990 | Nakanishi et al. . |
| 4,986,541 | 1/1991 | Teramoto et al. . |
| 4,995,609 | 2/1991 | Parente et al. . |
| 5,026,056 | 6/1991 | McNally et al. . |
| 5,046,733 | 9/1991 | Antonious . |
| 5,067,711 | 11/1992 | Parente et al. . |

FOREIGN PATENT DOCUMENTS

| | | |
|---|---|---|
| 371974 | 3/1932 | United Kingdom . |

OTHER PUBLICATIONS

"Some of Our Best Friends are Hookers and Pushers", Golf World, Jan. 1974, p. 45.

"The Ounce That Counts", Golf World, Jan. 24, 1975, pp. 46 & 47.

"Stroke-Savers," Golf Digest, Mar. 1988, pp. 82 & 83.

"FTD Iron by First Flight", Golf World, May 23, 1972, p. 10.

"The Wilson Staff Dynapower iron", Time Magazine, Mar. 24, 1967, p. 1.

"T.P. Super Blade", Golf World, Jun. 13, 1972, p. 25.

*Primary Examiner*—V. Millin
*Assistant Examiner*—Steven B. Wong
*Attorney, Agent, or Firm*—William W. Haefliger

[57] ABSTRACT

A golf club head having a body defining a heel, toe, top wall, sole and a front wall defining an upwardly and rearwardly inclined front face and rear face, the body defining a forwardly extending main recess located rearwardly of the front wall; and the body also defining an undercut recess located directly rearwardly of the front wall rear face and extending outwardly from the main recess toward the top wall and toward the bottom wall, adjacent the rear face, the rear face having a slant height dimension $D_1$ between uppermost and lowermost extents of the undercut recess in a vertical plane, and the front wall having a slant height dimension $D_2$ between uppermost and lowermost extents thereof in the plane, where:

$$90 < D_1/D_2 < 0.95.$$

29 Claims, 5 Drawing Sheets

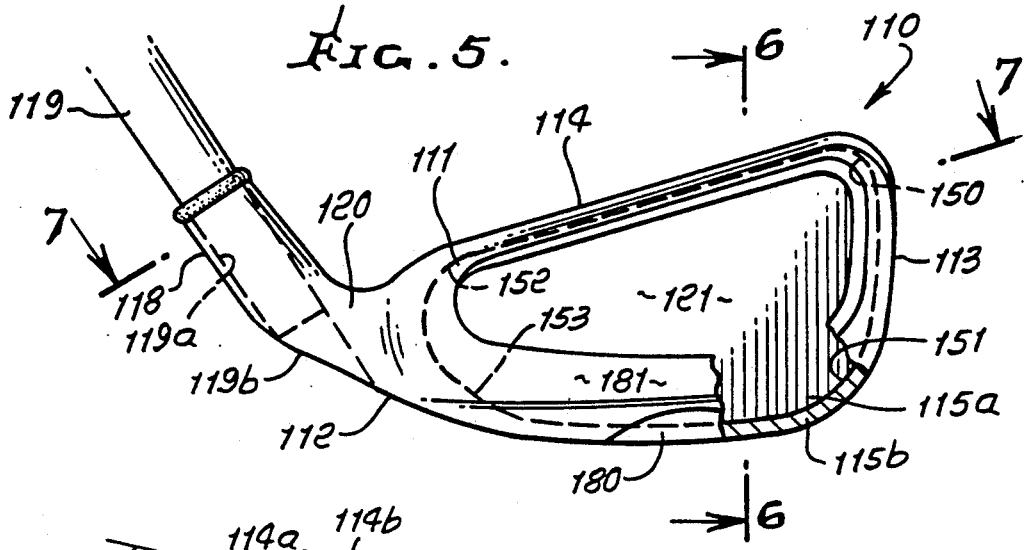
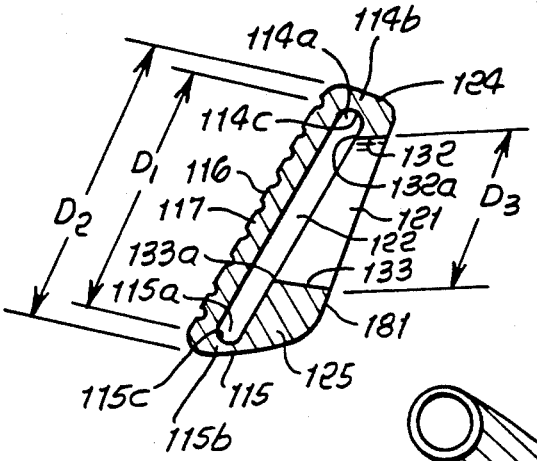
FIG. 6.
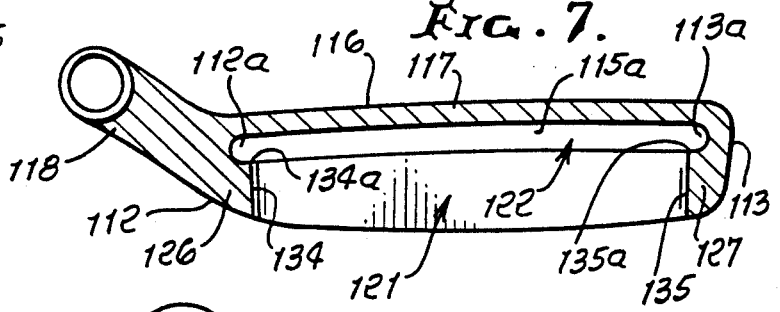
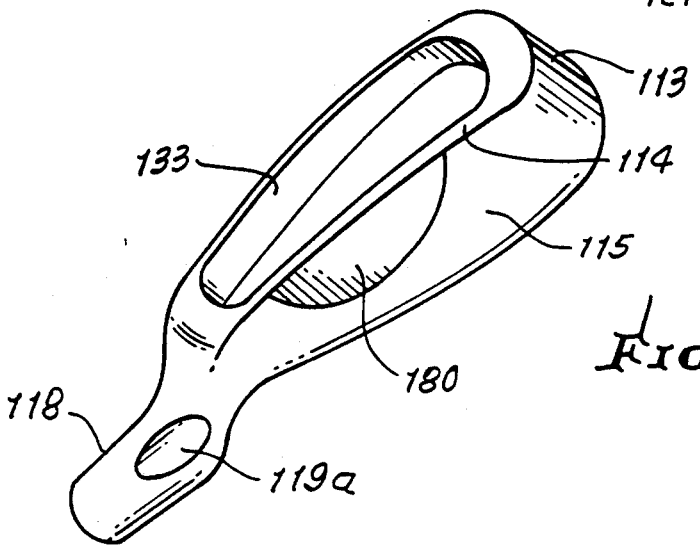
FIG. 8.

FIG. 9.
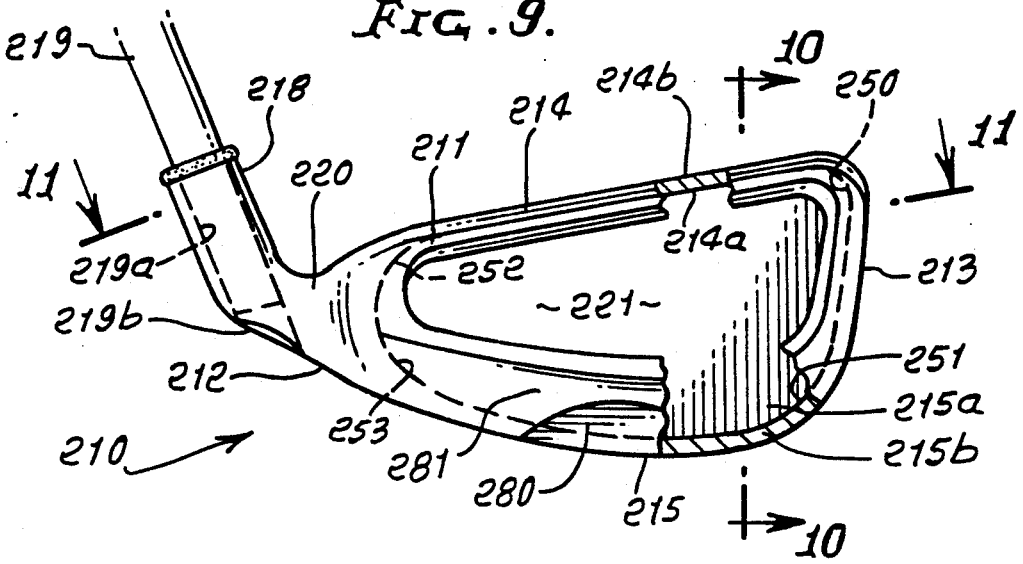
FIG. 11.
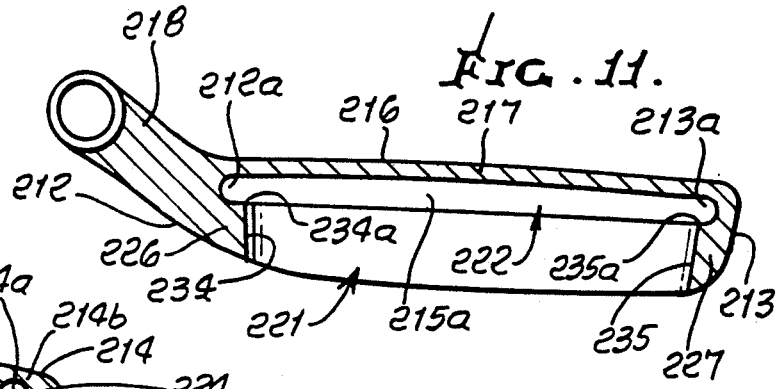
FIG. 10.
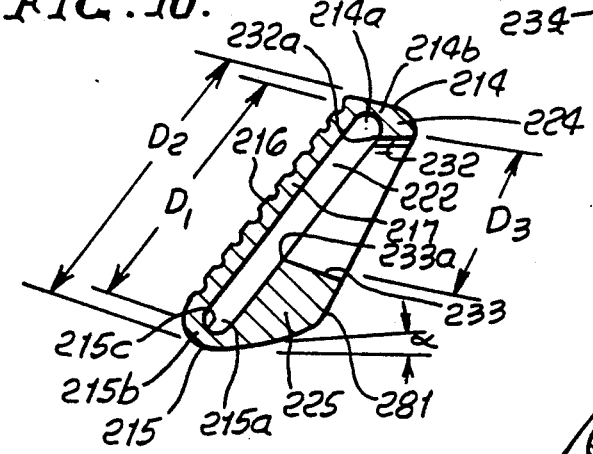
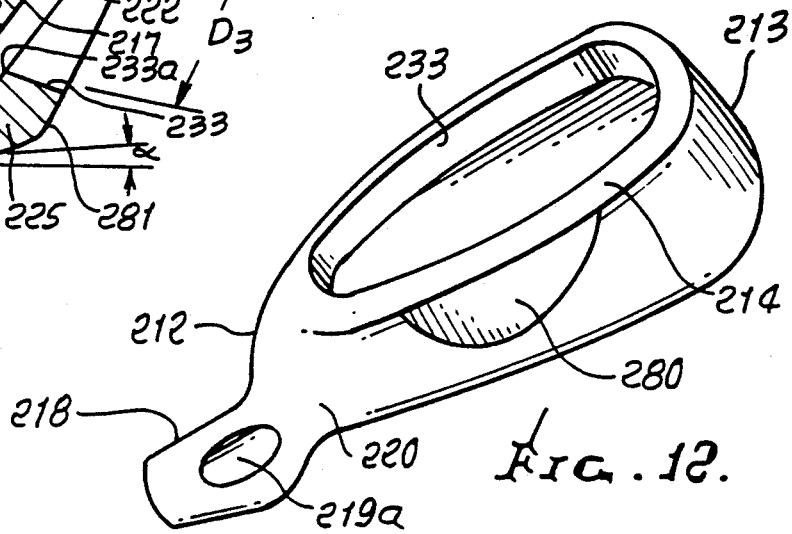
FIG. 12.

IRON GOLF CLUB HEAD WITH DUAL INTERSECTING RECESSES

This application is a continuation-in-part of Ser. No. 921,857 filed Aug. 5, 1992 now U.S. Pat. No. 5,282,625.

BACKGROUND OF THE INVENTION

This invention relates generally to golf clubs, and more particularly to golf club irons of improved construction to achieve advantages, such as twist resistance, during impact with golf balls, and delayed momentum transfer to golf balls during stroking. In this regard, and in the past, irons evolved in design from flat back to hollow back structure, the present invention providing a further evolution in back structure to achieve virtual head enlargement effects.

Many efforts have been made to design iron heads to achieve higher energy availability for transfer to the golf ball when the ball is impacted by the head. However, no way was known, to our knowledge, to achieve delayed momentum transfer to the ball, over the very short time interval when the ball remains in contact with the head face, in the novel and unusual manner as achieved by the present invention; and no way was known to couple such delayed energy transfer with head twist resistance, in the manner to be described.

SUMMARY OF THE INVENTION

It is a major object of the invention to provide an improved iron head construction meeting the need for delayed momentum transfer to the ball during club stroking, and also to provide club head increased twist resistance. Basically, the invention as embodied in a head metallic body, is constructed to define two intersecting recesses rearwardly of the head front wall, and bounded by head metallic extents projecting rearwardly proximate peripheral regions of the head face defining front wall. For example, the head may include:

a) a body defining a forwardly extending main recess located rearwardly of the front wall, b) and the body also defining an undercut recess located directly rearwardly of the front wall and extending outwardly from the main recess toward at least two of the following:

i) the top wall ii) the bottom wall iii) the toe iv) the heel.

As will be seen, the undercut recess may extend outwardly from its intersection with the main recess toward all of the top and bottom walls, and the toe and heel, whereby the undercut recess may then bound the main recess. This construction facilitates slightly delayed forward transfer of momentum of the body metal rearwardly of the undercut recess, to the front wall and front face, via peripheral extents of the head. Typically, the metal of the head has reduced thickness directly rearwardly of the front wall periphery, due to the provision of the undercut recess, as referred to. This also enables reallocation of some metal to project rearwardly from the looping recess, enhancing head peripheral weighting for anti-twist effect.

Another object is to extend undercut recess upwardly and downwardly into proximity with the uppermost and lowermost extents of the head front face, and to redistribute head metal to project rearwardly of the undercuts, whereby a significant sweet spot enlarging effect is achieved. Lateral sweet spot enlargement is also provided by undercuts at the toe and heel.

Another objective is to provide an undercut recess, as referred to, which extends in a loop that lies generally parallel to the inclined front face of the iron. The inclination of that loop varies with the number of the iron, designating different front face inclinations, as for example 1 to 9 irons and wedges.

A further object is to provide the head with a rearward projection with upward thickening between the bottom wall and the main recess, and rearwardly of the undercut recess that extends toward the bottom wall; and the head may also have a rearward projection with downward thickening between the top wall and the main recess, and rearwardly of the undercut recess that extends toward the top wall.

Yet another object is to provide a set of irons, each iron incorporating the dual intersecting recesses, as referred to, and the rearward projections extending generally horizontally irrespective of the angles of the front faces of the irons in the set.

These and other objects and advantages of the invention, as well as the details of illustrative embodiments, will be more fully understood from the following specification and drawings, in which:

DRAWING DESCRIPTION

FIG. 5 is a view like FIG. 1 but showing a #6 iron incorporating the invention;

FIG. 6 is a vertical section taken on lines 6—6 of FIG. 5;

FIG. 7 is a section on lines 7—7 of FIG. 5;

FIG. 8 is a rear perspective view of the FIG. 5 head;

FIG. 9 is a view like FIG. 1 showing a #8 iron incorporating the invention;

FIG. 10 is a vertical section taken on lines 10—10 of FIG. 9;

FIG. 11 is a section taken on lines 11—11 of FIG. 9;

FIG. 12 is a rear perspective view of the FIG. 9 head;

DETAILED DESCRIPTION

Figure 1:
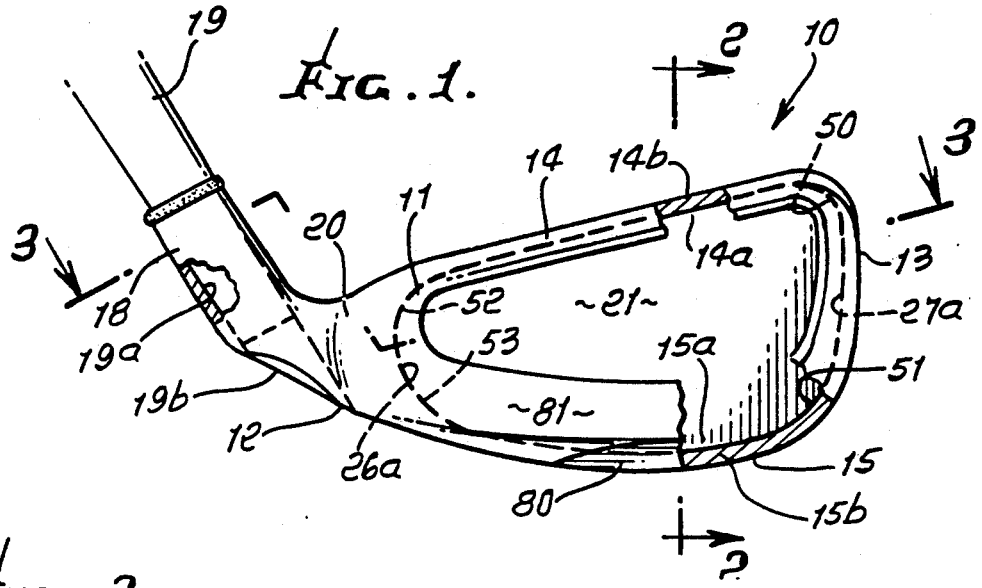
FIG. 1 is a rear elevation of a #1 iron of a golf club set incorporating the invention.

Referring first to FIG. 1, the illustrated golf club head 10, in the form of a #1 iron of a set, has a body 11 defining a heel 12, toe 13, top wall 14, and bottom wall or sole 15. The body also defines an upwardly and rearwardly inclined front face 16 at the frontal side of an associated front wall 17. A hosel is shown at 18 and integrally Joins the body via neck 20; and a shaft 19 extends into a bore **19*a* that extends through the hosel as seen at bottom bore opening 19*b*, and is anchored therein in a suitable manner. Opening 19*b*** may be suitably plugged. The head and hosel may consist of a one-piece, metallic, steel casting, other metals and alloys being usable.

In accordance with the invention, the body defines two intersecting recesses related to rearwardly elongated body projections, typically extending rearwardly, as will be described, irrespective of the head front face angularity. The two recesses include a forwardly and rearwardly extending main recess 21, and an undercut recess 22 located directly rearwardly of the front wall and extending laterally outwardly from the forwardmost extent of the main recess 21, toward at least two of the following:

i) top wall 14 ii) bottom wall or sole 15 iii) the toe region 13 iv) the heel region 12.

Figure 2:
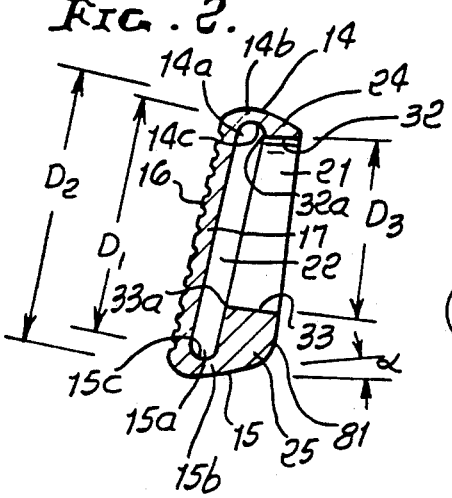
FIG. 2 is a section taken on lines 2—2 of FIG. 1.

Typically, the undercut recess portions 14*a* and 15*a*, associated with walls 14 and 15, are elongated directionally between the toe and heel, over the major length of the head, thereby achieving a large portion of the benefits of the invention. These benefits include metal redistribution toward the upper and lower peripheries of the head, and projecting rearwardly at 24 and 25, for enhancing anti-twist of the head during stroking and ball impact. Such metal rearward redistribution, i.e., lengthening in a rearwardly direction, as at 24 and 25, rearwardly of undercuts 14*a* and 15*a*, is believed to achieve somewhat delayed momentum transfer from the metal portions 24 and 25, to the front wall and front face 16, thereby maintaining a greater time interval of front face contact with the ball during stroking, for better ball control. The size and mass of the lower projection 25 substantially exceeds the size and mass of the upper projection 24, as is seen in FIG. 2, enhancing the delay effect.

Note that such momentum transfer, visualized in the form of forward waves, is required to pass around and through the reduced thickness forward portions 14*b* and 15*b* of the rearwardly projecting portions 24 and 25, enhancing such delay. Such delay of wave travel through narrowed regions (or webs or bridges) 14*b* and 15*b* is facilitated by the outwardly concave curvature at 14*c* and 15*c*, or other similar thickness narrowing shape, bounding the outermost extents of the undercuts 14*a* and 15*a*. Enhanced performance and ball control have been determined by repeated, actual use of such an iron, both with humans and robots. A sweet spot enlarging effect (vertically) is achieved without requiring head vertical enlargement. Note that the undercuts 14*a* and 15*a* are near the uppermost and lowermost extents of face 16, and the slant height dimension $D_1$ of the undercut recess is 90% to 95% of the slant height $D_2$ of face 16. Thus, $$0.90 < D_1/D_2 < 0.95.$$

The undercut recess portions 12*a* and 13*a*, associated with the heel and toe, and associated metal redistribution rearwardly and functionally outwardly (i.e., enlarging effect) from those undercuts, contribute to and add to the same effects as described above for the undercut recess portions 14*a* and 15*a*, i.e., the sweet spot is enlarged toward the toe and heel. The undercut recess projects outwardly at 12*a*, 14*a*, and 15*a* at the heel, toe and toward the top walls, respectively, i.e., from the edges 34*a*, 35*a*, and 32*a*, to an extent $w_1$ (which may vary, as shown); however, the front-to-rear thickness $t_1$ of the undercut recess is approximately as follows:

$$0.5t_1 < w_1 < 1.5t_1$$

Note that the undercut recess at 15*a* projects downwardly from edge 33*a* to an extent between 1.5 and 2.5 times $w_1$.

The radii of the circular curvatures at 14*c* and 15*c* are typically between 0.150 and 0.160 inches for #1 through #7 irons; between 0.210 and 0.230 for #8 and #9 irons; and between 0.300 and 0.320 for a pitching wedge; however, these dimensions can vary.

Figure 3:
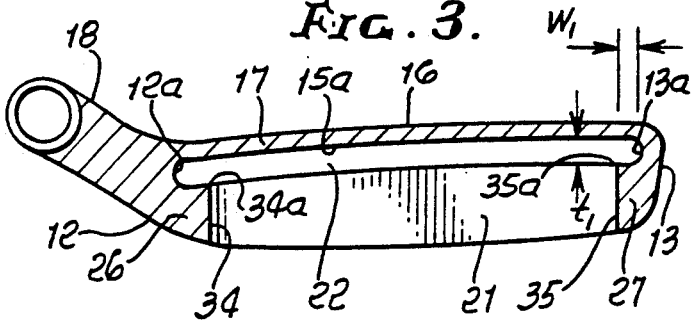
FIG. 3 is a section on lines 3—3 of FIG. 1.
Figure 4:
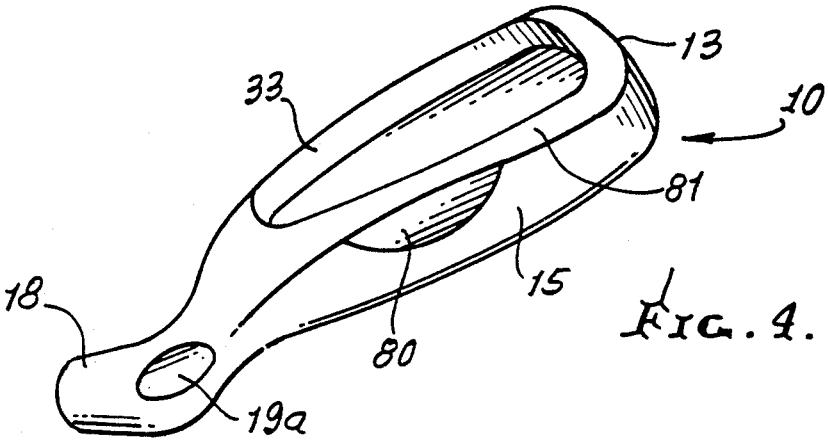
FIG. 4 is a rear perspective view of the FIG. 1 head.
Figure 13:
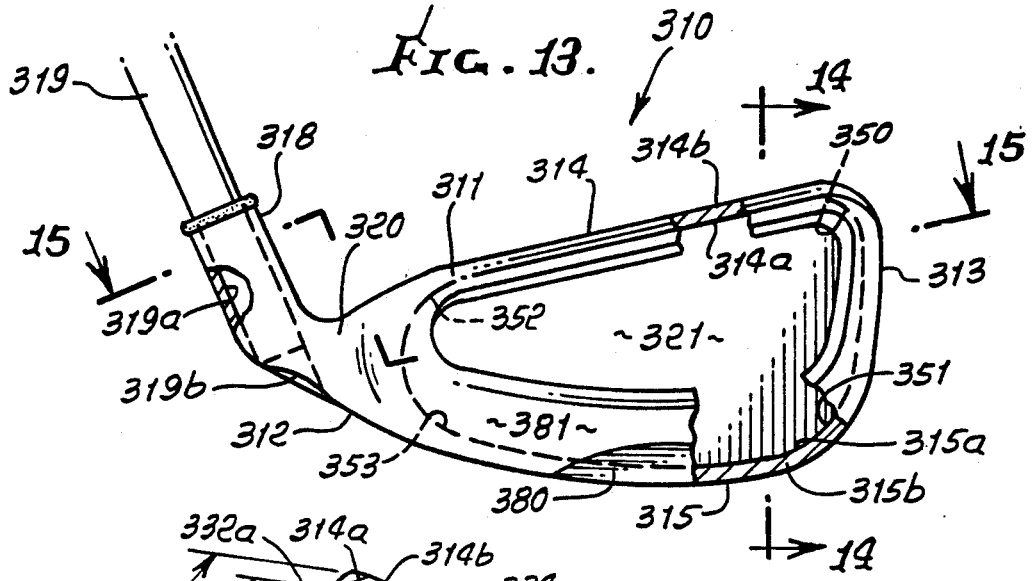
FIG. 13 is a view like FIG. 1 showing the rear side of a pitching wedge incorporating the invention.
Figure 14:
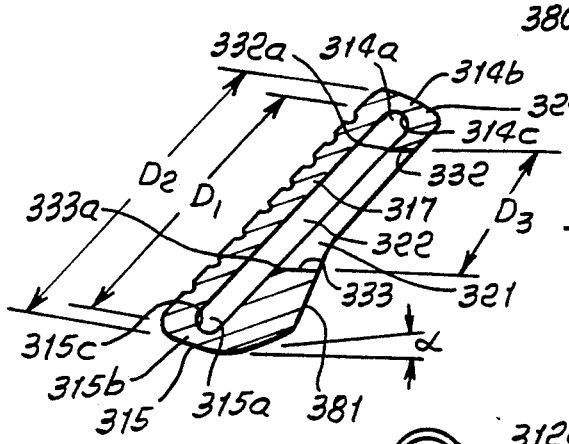
FIG. 14 is a vertical section taken on lines 14—14 of FIG. 13.
Figure 15:
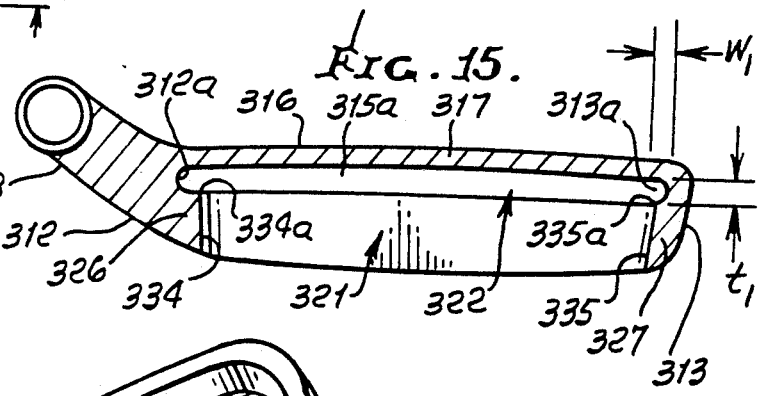
FIG. 15 is a section taken on lines 15—15 of FIG. 13.
Figure 16:
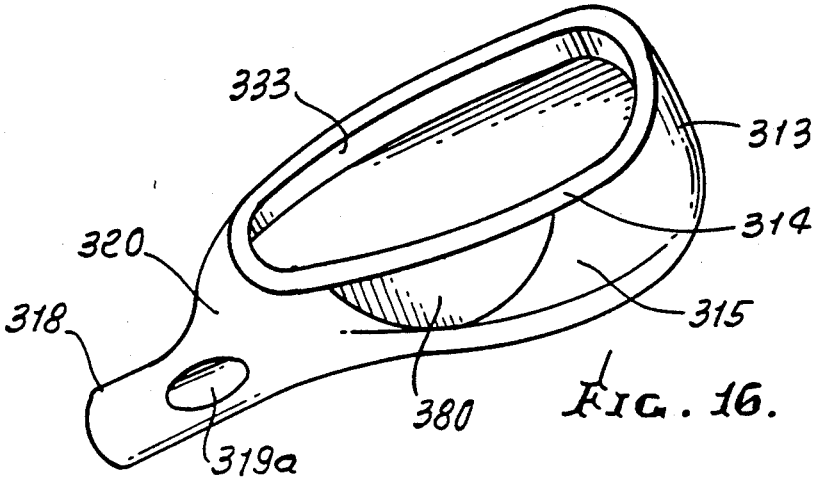
FIG. 16 is a rear perspective view of the FIG. 13 head.

Note in this regard the rearward projections 26 and 27 in FIG. 3, extending rearwardly from the undercuts 12*a* and 13*a*, and also rearward projections at 24 and 25. Such rearward projections 24 and 25, 26 and 27, are elongated directly rearwardly of the undercuts 12*a*, 13*a*, 14*a*, and 15*a*, and in relation to their thickness dimensions, showing that metal has been redistributed to those projections to enhance the effects described and without increasing the overall vertical dimension of the head.

The inner sides or ledges 32 and 33 defined by the projections 24 and 25 are substantially flat in a forward-to-rearward direction; however, they define a loop in combination with the corresponding inner and curved sides 34 and 35 of the projections 26 and 27, that loop subtending the major aerial extent of the front face, including an enlarged "sweet spot". Correspondingly, all undercut recess portions 12*a*, 13*a*, 14*a*, and 15*a*, also define, preferably, a loop. Undercut recess concave corners appear at 50, 51, 52, and 53. Dimension $D_3$ between 32 and 33 is substantially less than $D_1$ at all sections parallel to the section of FIG. 2. The undercut recess has a periphery defining an area $A_1$ within that periphery, the front face 16 having a maximum area, where $$0.90 < A_1/A_2 < 0.95$$

It is found that the undercut recess structure substantially enlarges the effective sweet spot, at the face 16. Side 32 is inclined upwardly and rearwardly from horizontal at between 1° and 3°; and side 33 is inclined downwardly and rearwardly from horizontal at between 1° and 3°. Bottom wall 15 is inclined at $\alpha$ upwardly and rearwardly from horizontal at between 5° and 8°. A local relief facet 80 (inclined upwardly and rearwardly) is provided beneath the sweet spot location to intersect bottom wall 15 and rear surface 81.

Figure 17:
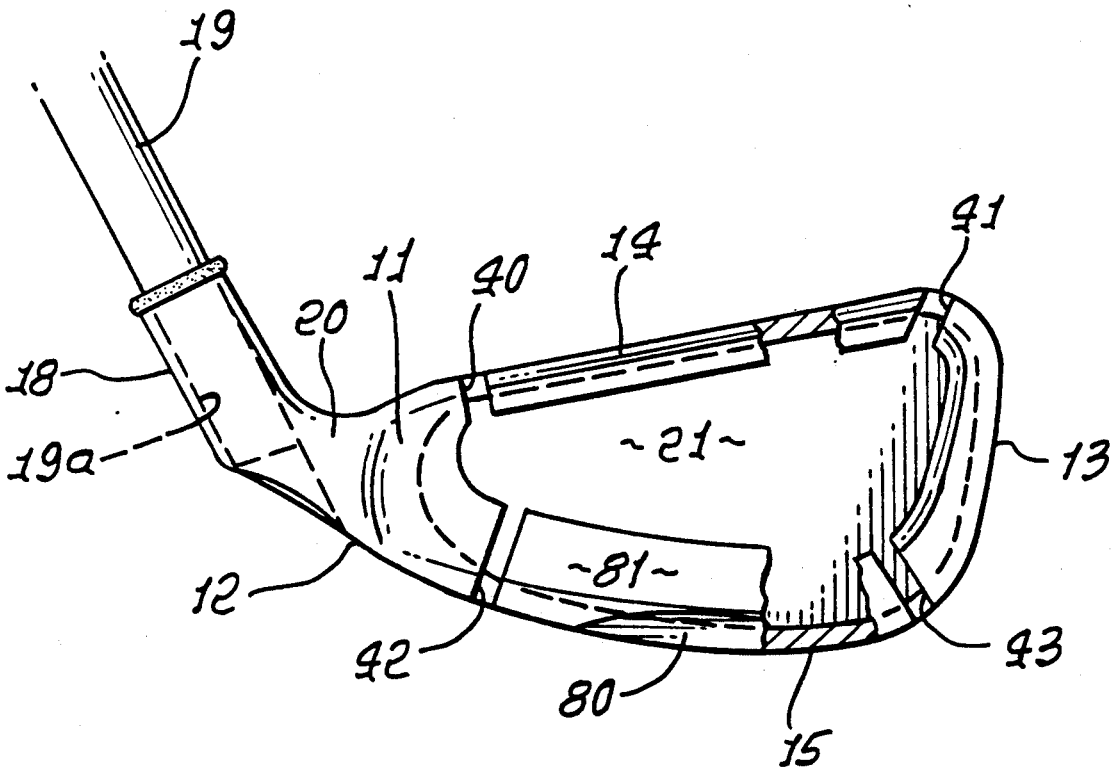
FIG. 17 is a view like FIG. 1 showing corner slots.

FIG. 17 shows that slots may be provided, as at 40–43, proximate corners of the loop defined by the rearward projections 24–27 to decouple or reduce the stiffening effect of joining the rearward extending portions 24–27 at the loop corners. This allows the momentum transfer from each of such portions to independently proceed forwardly, with delayed action, as referred to, without being affected by the momentum transfer associated with the other portions, or attenuated by the effects of such other portions.

FIGS. 5–8 show a corresponding construction of a #6 iron, having a more inclined front face, as shown. The corresponding numbered elements are the same as those in FIGS. 1–4, with each number preceded by a 1, i.e., providing a one hundred series of numbers.

FIGS. 9–12 correspond to FIGS. 1–4, but show a #8 iron with the two intersecting recesses in associated structure, as defined above. The corresponding elements have a 2 preceding each number, whereby a two hundred series of elements is defined.

FIGS. 13–16 correspond to FIGS. 1–4, but show a pitching wedge with the two recesses in associated structure, as defined above. The corresponding elements have a 3 preceding each number, whereby a three hundred series of elements is defined.

It will be understood that intermediate irons have the same construction, but with associated changing front face inclinations, as in a set of such irons. Accordingly, each iron of the set has the invention incorporated therein.

We claim:

1. A golf club head having a body defining a heel, toe, top wall, sole, and a front wall defining an upwardly and rearwardly inclined front face and rear face, and comprising a) said body defining a forwardly extending main recess located rearwardly of said front wall, b) and said body also defining an undercut recess located directly rearwardly of said front wall rear face and extending outwardly from said main recess toward said top wall and toward said bottom wall, adjacent said rear face, said rear face having a slant height dimension $D_1$ between uppermost and lowermost extents of said undercut recess in a vertical plane, and said front wall having a slant height dimension $D_2$ between uppermost and lowermost extents thereof in said plane, where:

$$0.90<D_1/D_2<0.95.$$

2. The golf club head of claim 1 wherein said undercut recess also extends outwardly from said main recess and adjacent said front wall rear face toward said toe.

3. The club head of claim 2 wherein said undercut recess extends outwardly from said main recess and adjacent said front wall rear face toward said heel, said undercut recess having a periphery defining an area $A_1$ within said periphery, and said front face having a maximum area $A_2$, where $$0.90<A_1/A_2<0.95.$$

4. The golf club head of claim 1 wherein said top wall and bottom wall have substantially reduced thickness outwardly of said undercut recess.

5. The golf club head of claim 4 wherein said undercut recess extends in a loop that is generally parallel to the inclined front face.

6. The golf club head of claim 4 wherein said undercut recess extends outwardly toward said top wall and toward said bottom wall, the depth of the undercut recess toward said top wall being lesser than the depth of said undercut recess toward said bottom wall.

7. The golf club head of claim 6 wherein said undercut recess that extends toward said top wall has a substantially semi-circular cross section adjacent said top wall, and said undercut recess toward said bottom wall has a substantially semi-circular cross section adjacent said bottom wall.

8. The golf club head of claim 6 wherein said undercut recess proximate said heel and proximate the toe decreases gradually in depth in an upward direction.

9. The golf club head of claim 1 wherein said head has rearward projection with upward thickening between said bottom wall and said main recess, and rearwardly of said undercut recess that extends toward said bottom wall, said undercut recess that extends toward said bottom wall having forward and rearward sides that extend parallel to one another.

10. The golf club head of claim 9 wherein said head has rearward projection with downward thickening between said top wall and said main recess, and rearwardly of said undercut recess that extends toward said top wall, said undercut recess that extends toward said top wall having forward and rearward sides that extend parallel to one another.

11. The golf club head of claim 9 wherein said rearward projection from the undercut recess has substantially greater overall rearward dimension than vertical thickness dimension.

12. The golf club head of claim 1 wherein said head has rearward projection with downward thickening between said top wall and said main recess, and rearwardly of said undercut recess that extends toward said top wall, said undercut recess that extends toward said top wall having forward and rearward sides that extend parallel to one another.

13. The golf club head of claim 12 wherein said rearward projection from the undercut recess has substantially greater overall rearward dimension than vertical thickness dimension.

14. The golf club head of claim 1 wherein said body is metallic.

15. The golf club head of claim 14 wherein said body is a one-piece casting, and defines an iron golf club head.

16. The golf club of claim 1 wherein said body consists of a metallic casting.

17. The golf club head of claim 1 wherein said undercut recess projects outwardly to an extent $w_1$, and has front to rear thickness $t_1$, where $$0.5t_1<w_1<1.5t_1.$$

18. The golf club head of claim 1 wherein said body has at least one slit extending rearwardly from said undercut recess and extending outwardly from said main recess.

19. The golf club head of claim 1 wherein said body has four slits extending rearwardly from said undercut recess and extending outwardly from said main recess at the following locations:

proximate the junction of the heel and top wall
proximate the junction of the heel and bottom wall
proximate the junction of the toe and top wall
proximate the junction of the toe and bottom wall.

20. The golf club head of claim 1, including slots formed in corners defined by said head and intersecting said undercut recess.

21. The golf club head of claim 20 wherein there are four of said slots, two of which are proximate the head toe, and two of which are proximate a jucture defined by the hosel and head.

22. The head of claim 1 wherein said main recess, proximate said undercut recess, has a slant height dimension $D_3$ in said vertical plane, where $$D_3<D_1<D_2.$$

23. The head of claim 22 wherein said main recess, proximate said undercut recess, has a slant height dimension $D_3$ in said vertical plane, where $$D_3<D_1<D_2$$

and wherein said rearward projection with upper thickening defines a top ledge, and said rearward projection with downward thickening defines a bottom ledge, said ledges having relative forward taper toward their intersection with said undercut recess.

24. A golf club head having a body defining a heel, toe, top wall, sole and a front wall defining an upwardly and rearwardly inclined front face, and comprising a) said body defining a forwardly extending main recess located rearwardly of said front wall, b) and said body also defining an undercut recess located directly rearwardly of said front wall and extending outwardly from said main recess toward the following:

i) said top wall ii) said bottom wall, said undercut recess proximate said top wall having lesser depth than said undercut recess proximate said bottom wall, c) said undercut recess having uppermost and lowermost extents defining a separation distance $D_1$, the front face having uppermost and lowermost extents defining a separation distance $D_2$, where $$0.90<D_1/D_2<0.95.$$

25. The golf club head of claim 24 wherein said top wall has minimum thickness proximate said undercut recess extending toward the top wall, said bottom wall has minimum thickness proximate said undercut recess extending toward said bottom wall, and said two minimum thicknesses are approximately equal.

26. The golf club head of claim 24 wherein said minimum thicknesses are between 0.075 and 0.085 inches.

27. Multiple golf club heads in a set, each head having a body defining a heel, toe, top wall, sole and a front wall defining an upwardly and rearwardly inclined front face, and comprising a) said body defining a forwardly extending main recess located rearwardly of said front wall, b) and said body also defining an undercut recess located directly rearwardly of said front wall and extending outwardly from said main recess toward at least three of the following:

i) said top wall ii) said bottom wall iii) said toe iv) said heel, c) the undercut recesses in said bodies of the set having increasing rearward angularity in correspondence to increasing rearward angularity of the inclined front faces of the bodies of the set, d) the undercut recesses in each body of the set having parallel forward and rearward walls, e) said front wall having front and rear faces, said rear face having a slant height dimension $D_1$ between uppermost and lowermost extents of said undercut recess in a vertical plane, and said front wall having a slant height dimension $D_2$ between uppermost and lowermost extents thereof in said plane, where: $0.90<D_1/D_2<0.95$.

28. The invention of claim 27 wherein in each of said bodies, the undercut recess projects toward the top wall and toward the bottom wall as defined, the undercut recess projecting toward the top wall having depth less than the undercut recess projecting toward the bottom wall.

29. A golf club head having a body defining a heel, toe, top wall, bottom wall, a sole, and a front wall defining an upwardly and rearwardly inclined front face, and comprising a) said body defining a forwardly extending main recess located rearwardly of said front wall, b) and said body also defining an undercut recess located directly rearwardly of said front wall and extending outwardly from said main recess toward at least said top wall and said bottom wall, c) each of said top and bottom walls having a maximum vertical thickness region rearwardly of and adjacent said undercut recess, said top wall tapering rearwardly and being rearwardly elongated rearwardly of said undercut recess to overlie said main recess, and said bottom wall tapering rearwardly and being rearwardly elongated rearwardly of said undercut recess to underlie said main recess, said top wall defining a reduced thickness web adjacent to and above said undercut recess, said web located rearwardly of the uppermost level of said front face, and said undercut recess nearest said web extending upwardly to a level proximate said uppermost level of said front face, d) said rear face having a slant height dimension of $D_1$ between uppermost and lowermost extents of said undercut recess in a vertical plane, and said front wall having a slant height dimension $D_2$ between uppermost and lowermost extents thereof in said plane, where:

$$0.90<D_1/D_2<0.95.$$

* * * * *